United States Patent [19]

Saunders

[11] 3,937,205

[45] Feb. 10, 1976

[54] BOW STRING FINGER GUARD

[75] Inventor: Charles A. Saunders, Columbus, Nebr.

[73] Assignee: Saunders Archery Co., Columbus, Nebr.

[22] Filed: Jan. 24, 1974

[21] Appl. No.: 436,158

[52] U.S. Cl. ..... 124/30 A

[51] Int. Cl.[2] ..... F41B 5/00

[58] Field of Search .... 124/30 A, 30 R, 23 R, 24 R, 124/41, 25

[56] References Cited

UNITED STATES PATENTS

| | | | |
|---|---|---|---|
| 2,777,437 | 1/1957 | Allen | 124/30 A |
| 2,910,058 | 10/1959 | Bender | 124/30 A |
| 3,135,020 | 6/1964 | Holl et al. | 124/30 A X |
| 3,340,862 | 9/1967 | Saunders | 124/30 A |
| 3,375,815 | 4/1968 | Novak | 124/30 A X |
| 3,756,215 | 9/1973 | Black | 124/30 A |

*Primary Examiner*—Richard C. Pinkham
*Assistant Examiner*—William R. Browne
*Attorney, Agent, or Firm*—Glenn E. Klepac; Michael G. Berkman

[57] ABSTRACT

A finger guard for attachment to an archery bow string, comprising a pair of flexible plastic sleeves each having a through axial bore, a pair of string indexing devices positively positionable on the bow string at opposed extremities of the sleeves, and a pair of rigid washers for placement on the string between the sleeves and the indexing devices. The sleeves are each integrally formed with finger stop means and with a ring-like spacer and abutment member to provide a zone of physical separation between an archer's fingers and the nock end of an arrow.

4 Claims, 9 Drawing Figures

BOW STRING FINGER GUARD

BACKGROUND OF THE INVENTION

This invention relates to finger guards affixed to bow strings to cushion the fingers of an archer against undue localized pressure by the strings.

When an archer draws a bow string, forces of up to 100 pounds or more are distributed over a surface of the fingers having an area of less than one-half square inch. In order to cushion the fingers against undue localized pressure in this situation, sleeve-like guards fitting over the string are used to spread the applied force over a greater area of the fingers. However, such finger guards of the prior art suffer from one or more disadvantages making them less than completely suitable for their intended purpose.

For example, two commercially available finger guards each include a pair of cylindrical shells adapted to fit over a bow string. Each shell is formed with a small annular radially extending projection of an end of the shell adjacent the nock receiving portion of the bow string. While these small annular projections do afford some protection to the fingers when only small forces are applied to the string, distortion of the guard accompanying application of forces of 100 pounds or more often allows the fingers to be pinched between the nock end of the arrow and the string.

In the prior art finger guards are fastened at fixed positions on the bow string without causing permanent damage to the string. The string indexing devices described in U.S. Pat. No. 3,340,862 may be fastened to the string at two spaced locations with the sleeves placed between upper and lower string indexing devices. However, when very large forces are applied to the flexible cylindrical shells of the finger guard, the shells tend to slide over the indexing devices.

SUMMARY OF THE INVENTION

It is a principal object of the present invention to provide a finger guard including a ring-like spacer forming a zone of physical separation between an archer's finger and the nock end of an arrow, thereby precluding pinching of the finger between the string and arrow even when very large drawing forces are applied to the string.

A related object of this invention is to provide a finger guard having a ring-like spacer integrally formed with a sleeve cushioning the fingers.

Another object of the invention is to provide, in a finger guard including a flexible sleeve and a string indexing device positively positionable on a bow string adjacent the sleeve, a rigid washer adapted for placement on the string between the sleeve and the indexing device to prevent slippage of the sleeve over and around the indexing device. In this way a relatively fixed spacing is maintained between the two sleeves comprising the finger guard of the invention.

Other and further objects and advantages of the invention will be evident upon a reading of the following specification taken in conjunction with the drawing in which.

Figures 1, 2, 3, 4, 5, 6, 7, 8, 9:
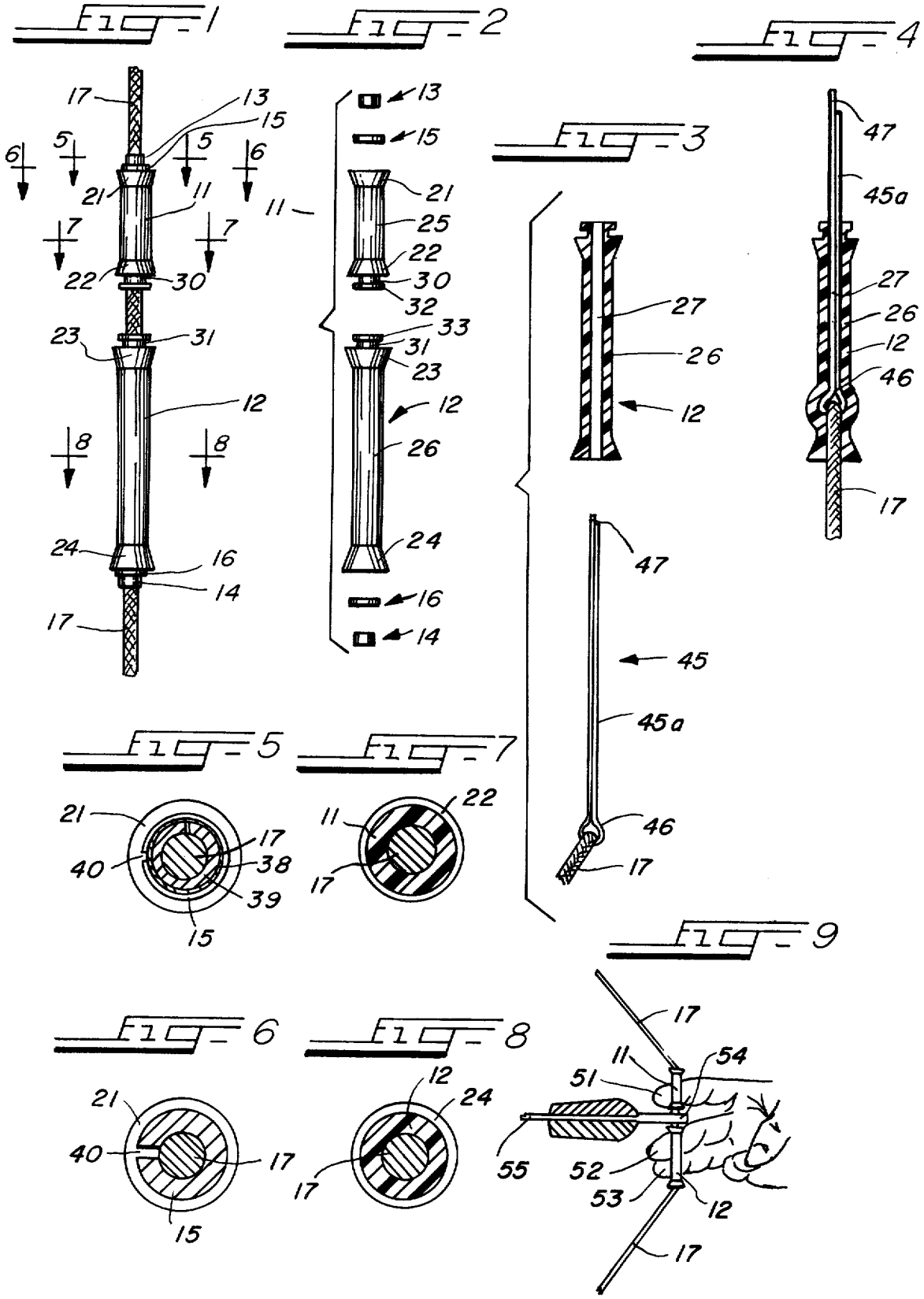
FIG. 1 is a side elevational view of a portion of a bow string showing one form of a finger guard of the invention, as carried by the bow string.
FIG. 2 is an exploded view of the finger guard of FIG. 1, showing the various component parts including the sleeves, washers and string indexing devices.
FIG. 3 is a vertical cross-sectional view of a sleeve of the finger guard of the invention, together with a split pin for threading the bow string through the sleeve.
FIG. 4 is a vertical cross-sectional view of a sleeve of the finger guard of the invention, showing the manner in which the split pin is used to pull the bow string through the axial bore of the sleeve.
FIG. 5 is a cross-sectional view through a string indexing device of the finger guard of the invention, taken along the line 5—5 of FIG. 1.
FIG. 6 is a cross-sectional view through a washer of the finger guard of the invention, taken along the line 6—6 of FIG. 1.
FIG. 7 is a cross-sectional view through a sleeve of the finger guard, taken along the line 7—7 of FIG. 1.
FIG. 8 is a cross-sectional view of a sleeve of the finger guard, taken along the line 8—8 of FIG. 1.
FIG. 9 is a fragmentary side elevational view of a bow string in conjunction with the nock end of an arrow, demonstrating use of the finger guard by an archer.

Referring now more particularly to FIGS. 1 and 2, the finger guard of the invention is seen to comprise two flexible rubber-like or plastic sleeves 11 and 12, two string indexing devices 13 and 14, and a pair of rigid plastic washers 15 and 16. In FIG. 1 the finger guard is mounted in assembled relation on a bow string 17, and in FIG. 2 the six component parts are shown in an exploded side elevational view.

The detailed structure of the sleeves 11 and 12 is shown in FIGS. 2, 3, 7 and 8. Each tubular sleeve is formed with a pair of annular or radially enlarged projections 21,22,23,24 comprising finger stops. The cylindrical barrel 25 of the upper sleeve 11 is sized to accommodate the second finger of an archer, and the corresponding barrel 26 of the lower sleeve 12 accommodates the third and fourth fingers. The respective finger stops provide a physical barrier to vertical movement of the fingers away from their proper positions on the sleeves, as well as providing locating means by which the archer can feel whether his fingers are appropriately placed. Each sleeve 25,26 is formed with a through axial bore 27 adapted to receive a bow string 17 therethrough, and to provide a snug frictional fit with the string 17.

Each sleeve is integrally formed with a coaxially extending ring-like spacer 30,31. The outer diameter of each spacer is preferably less than the outer diameter of the adjacent finger stop 22,23. The extremities of each spacer 30,31 are formed with annular hubs 32,33 constituting abutments to bracket the nock end of an arrow. Because of their small diameter and extreme flexibility, the ring-like spacers 30,31 provide the desired zones of physical separation between the fingers of an archer and the arrow without significantly adversely affecting flexibility of the sleeves. Thus, the archer's fingers remain sensitive to the "feel" of the arrow, without any danger of their being pinched between the arrow and the string when large drawing forces are applied.

String indexing devices 13 and 14 shown in FIGS. 1, 2 and 5 are positively positioned on the string 17. Each indexing device comprises a split annular metal ring 38 enveloping a compressible inner band 39. These points are removably fastened onto the bow string 17 by a pliers or similar crimping device.

One suitable form of string indexing device is described in U.S. Pat. No. 3,340,862. In order to preclude slippage of the flexible plastic sleeves 11 and 12 over the small indexing devices 13 and 14, rigid plastic washers 15 and 16 are placed on the string 17 between the sleeves 11 and 12 and the indexing devices 13 and 14. These washers 15 and 16 can also be formed from metal and other suitable rigid materials. Since the washers have outer diameters greater than the corresponding diameters of the indexing devices 13 and 14, they form effective barriers against slippage of the flexible sleeves past the indexing devices when drawing force is applied to the bow string 17. Each washer is formed with a radial slot 40, best seen in FIG. 6, to facilitate placement of the washer on the string 17.

As illustrated in FIGS. 3 and 4, a metal split pin 45 is utilized to facilitate positioning of the sleeves 11,12 on the string 17. The bow string 17 is looped through an "eye" 46 of the pin 45, the shaft 45a of the pin 45 is lubricated, and the free end 47 is pulled through the axial bore 27 of the sleeve 12. After each sleeve is placed on the string 17, the split pin 45 is withdrawn.

The mode of operation of the finger guard of the invention is demonstrated in FIG. 9. The nock end 54 of an arrow 55 is located on the string 17 between the two annular hubs 32 and 33 at the ends of the spacers 30 and 31. The archer then places his second finger 51 around the upper sleeve and his third and fourth fingers 52 and 53 are looped around the lower sleeve 12. When the fingers draw back on the string 17, a safe distance is maintained between the fingers and the arrow because of the zones of physical separation provided by the spacers 30 and 31. Pinching of the fingers between the nock end of the arrow and the string is thereby precluded.

The preceding disclosure of the invention has been made with reference to preferred structural embodiments that have proven most satisfactory in practice. It will be understood by persons skilled in the art that numerous changes and modifications can be made without departing from the spirit of the underlying invention. It is desired to include within the scope of the following claims all such changes and modifications by which substantially similar results may be obtained through the use of substantially the same or equivalent means.

What is claimed is:

1. A finger guard assembly adapted for attachment to a bow string for protectively cushioning bow-drawing fingers of an archer against objectionable localized finger pressures produced during gripping and pulling of a bow string in drawing a bow, said finger guard assembly including;

two separate flexible and resilient spool-like sleeves each formed with a through longitudinally extending axial bore sized to receive therethrough and thereby frictionally to grip a bow string threaded through said sleeves, when positioned on a bow string said sleeves being frictionally secured longitudinally of one another on a bow string as upper and lower sleeves, adjacent spaced ends of respective said sleeves generally demarcating an arrow nocking zone therebetween, said sleeves each being substantially tubular in form with opposite ends of each being radially enlarged annularly to define finger stops, thereby to ensure correct longitudinal positioning of fingers gripping said sleeves and to enhance retention of proper finger positions during drawing of the bow string.

arrow nock abutment means for bracketing and confining an arrow therebetween upon insertion of the arrow nock into the nocking zone between said sleeves, and spacer means interposed between said arrow nock abutment means and said finger stops, adjacent said spaced ends of respective said sleeves to separate said abutment means from said finger stops, said arrow nock abutment means and said spacer means constituting integral longitudinally coaxial extensions of said sleeves disposed at adjacent said spaced ends thereof to delineate the arrow nocking zone therebetween.

2. The structure as set forth in claim 1 wherein said arrow nock abutment means comprise annular hubs having generally planar end faces extending normally to a longitudinal axis of said sleeves, and wherein said spacer means comprise ring-like annular bands joining said hubs to said finger stops, each one of said bands having an outer diameter less than the outer diameter of said finger stops of said sleeves there-adjacent to ensure a high degree of flexibility of said spacer means and said sleeves;

thereby to provide a sense of feel of the arrow nock, said spacer means establishing a physical separation between an archer's fingers and the arrow nocking zone to prevent pinched contact of an archer's fingers between the arrow nock and a bow string during drawing of a bow.

3. The structure as set forth in claim 2 wherein each one of said annular hubs has an outer diameter greater than the outer diameter of said spacer means.

4. The finger guard assembly as set forth in claim 1 and further comprising locating means adapted for attachment to a bowstring above and below outer ends of respective said sleeves to prevent said sleeves from sliding on a bowstring in a direction away from the nocking zone, said locating means including a washer formed with a central opening for receiving a bow string therethrough, and said locating means including indexing means for attachment on a bowstring at points above and below respective said washers to preclude shifting of said washers along a bowstring in directions away from the nocking zone.

* * * * *